US008845285B2

(12) United States Patent
Weber et al.

(10) Patent No.: US 8,845,285 B2
(45) Date of Patent: Sep. 30, 2014

(54) GAS TURBINE STATOR ASSEMBLY

(75) Inventors: David Wayne Weber, Simpsonville, SC (US); Christopher Lee Golden, Greer, SC (US)

(73) Assignee: General Electric Company, Schnectady, NY (US)

( * ) Notice: Subject to any disclaimer, the term of this patent is extended or adjusted under 35 U.S.C. 154(b) by 502 days.

(21) Appl. No.: 13/347,269

(22) Filed: Jan. 10, 2012

(65) Prior Publication Data

US 2013/0177412 A1 Jul. 11, 2013

(51) Int. Cl.
*F01D 9/00* (2006.01)

(52) U.S. Cl.
USPC ..... 415/191; 415/173.1; 415/211.2

(58) Field of Classification Search
CPC ..... F01D 9/02; F01D 9/04; F01D 9/047; F05D 2240/55; F05D 2240/57
USPC ..... 415/115, 173.1, 191, 211.2
See application file for complete search history.

(56) References Cited

U.S. PATENT DOCUMENTS

| | | | | |
|---|---|---|---|---|
| 4,650,394 | A | 3/1987 | Weidner | |
| 4,902,198 | A | 2/1990 | North | |
| 5,088,888 | A * | 2/1992 | Bobo | 415/170.1 |
| 5,167,485 | A | 12/1992 | Starkweather | |
| 5,531,437 | A | 7/1996 | Coombs | |
| 5,531,457 | A | 7/1996 | Tibbott et al. | |
| 6,270,311 | B1 | 8/2001 | Kuwabara et al. | |
| 6,340,285 | B1 | 1/2002 | Gonyou et al. | |
| 6,712,581 | B2 * | 3/2004 | Florjancic et al. | 415/135 |
| 6,814,538 | B2 | 11/2004 | Thompson | |
| 7,217,081 | B2 | 5/2007 | Scheurlen et al. | |
| 7,524,163 | B2 * | 4/2009 | Self et al. | 415/115 |
| 8,182,208 | B2 | 5/2012 | Bridges, Jr. et al. | |
| 8,371,800 | B2 | 2/2013 | Meenakshisundaram et al. | |
| 2011/0217155 | A1 | 9/2011 | Meenakshisundaram et al. | |

FOREIGN PATENT DOCUMENTS

| | | | |
|---|---|---|---|
| EP | 2365188 | A1 | 9/2011 |
| GB | 2239679 | A | 7/1991 |
| WO | 9618025 | A | 6/1996 |

OTHER PUBLICATIONS

Extended European Search Report for EP Application No. 13150631.3-1610, dated May 24, 2013, pp. 1-8.

* cited by examiner

*Primary Examiner* — Ninh H Nguyen
(74) *Attorney, Agent, or Firm* — Cantor Colburn LLP

(57) ABSTRACT

According to one aspect, a turbine assembly includes a second component circumferentially adjacent to a first component, wherein the first and second components each have a surface proximate a hot gas path and a first side surface of the first component to be joined to a second side surface of the second component. The assembly also includes a first slot formed longitudinally in the first component which extends from a first slot inner wall to the first side surface and a second slot formed longitudinally in the second component which extends from a second slot inner wall to the second side surface. The assembly also includes a first groove formed in a hot side surface of the first slot, the first groove extending from the first slot inner wall to the first side surface, wherein the first groove comprises a tapered cross-sectional geometry.

20 Claims, 4 Drawing Sheets

GAS TURBINE STATOR ASSEMBLY

BACKGROUND OF THE INVENTION

The subject matter disclosed herein relates to gas turbines. More particularly, the subject matter relates to an assembly of gas turbine stator components.

In a gas turbine engine, a combustor converts chemical energy of a fuel or an air-fuel mixture into thermal energy. The thermal energy is conveyed by a fluid, often air from a compressor, to a turbine where the thermal energy is converted to mechanical energy. Several factors influence the efficiency of the conversion of thermal energy to mechanical energy. The factors may include blade passing frequencies, fuel supply fluctuations, fuel type and reactivity, combustor head-on volume, fuel nozzle design, air-fuel profiles, flame shape, air-fuel mixing, flame holding, combustion temperature, turbine component design, hot-gas-path temperature dilution, and exhaust temperature. For example, high combustion temperatures in selected locations, such as the combustor and areas along a hot gas path in the turbine, may enable improved efficiency and performance. In some cases, high temperatures in certain turbine regions may shorten the life and increase thermal stress for certain turbine components.

For example, stator components circumferentially abutting or joined about the turbine case are exposed to high temperatures as the hot gas flows along the stator. Accordingly, it is desirable to control temperatures in the stator components to increase the life of the components.

BRIEF DESCRIPTION OF THE INVENTION

According to one aspect of the invention, a turbine assembly includes a first component, a second component circumferentially adjacent to the first component, wherein the first and second components each have a surface proximate a hot gas path and a first side surface of the first component to abut a second side surface of the second component. The assembly also includes a first slot formed longitudinally in the first component, wherein the first slot extends from a first slot inner wall to the first side surface and a second slot formed longitudinally in the second component, wherein the second slot extends from a second slot inner wall to the second side surface and wherein the first and second slots are configured to receive a sealing member. The assembly also includes a first groove formed in a hot side surface of the first slot, the first groove extending proximate the first slot inner wall to the first side surface, wherein the first groove comprises a tapered cross-sectional geometry.

According to another aspect of the invention, a gas turbine stator assembly includes a first component to abut a second component circumferentially adjacent to the first component, wherein the first and second components each have a radially inner surface in fluid communication with a hot gas path and a radially outer surface in fluid communication with a cooling fluid. The first component includes a first side surface to abut a second side surface of the second component, a first slot extending from a leading edge to a trailing edge of the first component, wherein the first slot extends from a first slot inner wall to the first side surface, wherein the first slot is configured to receive a portion of a sealing member and a first groove formed in a hot side surface of the first slot, the first groove configured to receive the cooling fluid and to direct the cooling fluid along a hot side surface of the sealing member to the first side surface, wherein the first groove comprises a tapered cross-sectional geometry.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
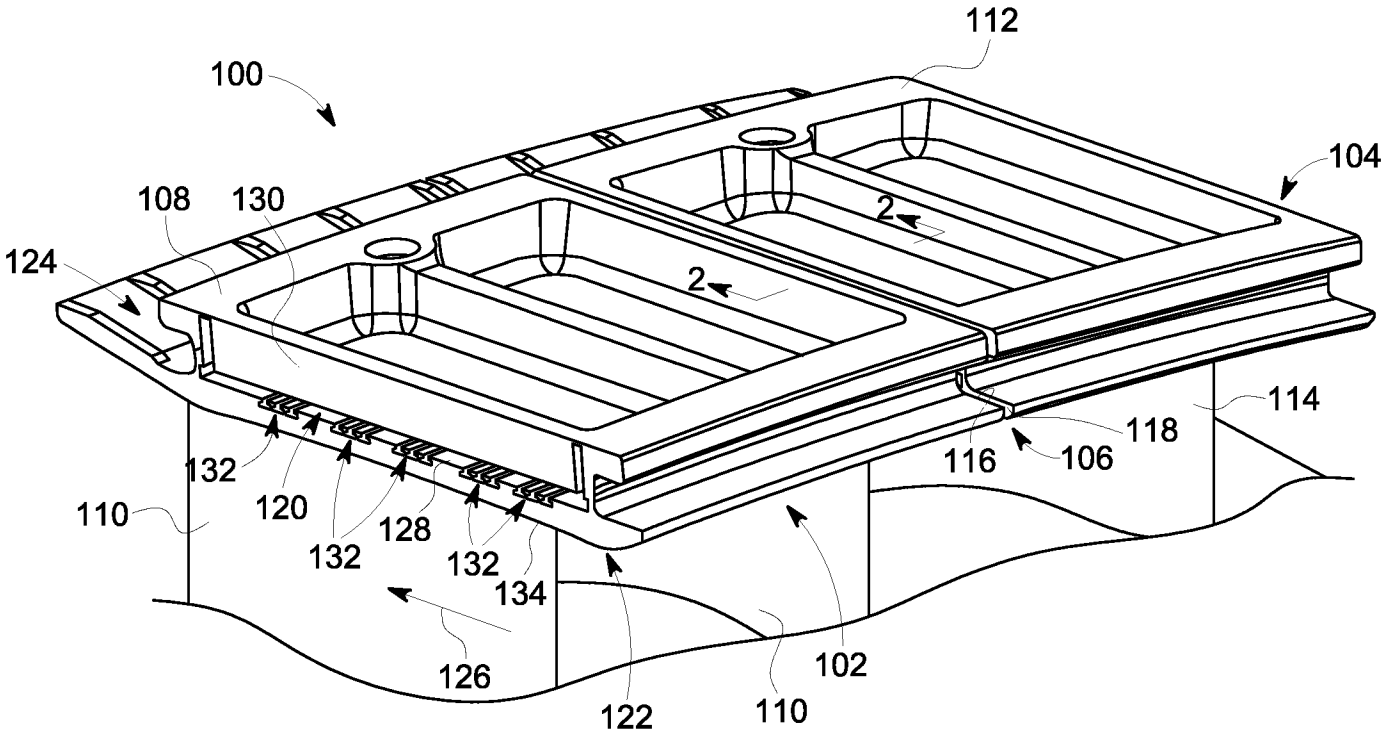
FIG. 1 is a perspective view of an embodiment of a turbine stator assembly.

FIG. 1 is a perspective view of an embodiment of a turbine stator assembly 100. The turbine stator assembly 100 includes a first component 102 circumferentially adjacent to a second component 104. The first and second components 102, 104 are shroud segments that form a portion of a circumferentially extending stage of shroud segments within the turbine of a gas turbine engine. In an embodiment, the components 102 and 104 are nozzle segments. For purposes of the present discussion, the assembly of first and second components 102, 104 are discussed in detail, although other stator components (e.g., nozzles) within the turbine may be functionally and structurally identical and apply to embodiments discussed. Further, embodiments may apply to adjacent stator parts sealed by a shim seal.

The first component 102 and second component 104 abut one another at an interface 106. The first component 102 includes a band 108 with airfoils 110 (also referred to as "vanes" or "blades") rotating beneath the band 108 within a hot gas path 126 or flow of hot gases through the assembly. The second component 104 also includes a band 112 with an airfoil 114 rotating beneath the band 112 within the hot gas path 126. In a nozzle embodiment, the airfoils 110, 114 extend from the bands 108, 112 (also referred to as "radially outer members" or "outer/inner sidewall") on an upper or radially outer portion of the assembly to a lower or radially inner band (not shown), wherein hot gas flows across the airfoils 110, 114 and between the bands 108, 112. The first component 102 and second component 104 abut one another or are joined at a first side surface 116 and a second side surface 118, wherein each surface includes a longitudinal slot (not shown) formed longitudinally to receive a seal member (not shown). A side surface 120 of first component 102 shows details of a slot 128 formed in the side surface 120. The exemplary slot 128 may be similar to those formed in side surfaces 116 and 118. The slot 128 extends from a leading edge 122 to a trailing edge 124 portion of the band 108. The slot 128 receives the seal member to separate a cool fluid, such as air, proximate an upper portion 130 from a lower portion 134 of the first component 102, wherein the lower portion 134 is proximate hot gas path 126. The depicted slot 128 includes a plurality of grooves 132 formed in the slot 128 for cooling the lower portion 134 and surface of the component proximate the hot gas path 126. In an embodiment, the first component 102 and second component 104 are adjacent and in contact with or proximate to one another. Specifically, in an embodiment, the first component 102 and second component 104 abut one another or are adjacent to one another. Each component may be attached to a larger static member that holds them in position relative to one another.

As used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The term "radial" refers to movement or position perpendicular to an axis or center line. It may be useful to describe parts that are at differing radial positions with regard to an axis. In this case, if a first component resides closer to the axis than a second component, it may be stated herein that the first component is "radially inward" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. Although the following discussion primarily focuses on gas turbines, the concepts discussed are not limited to gas turbines.

Figure 2:
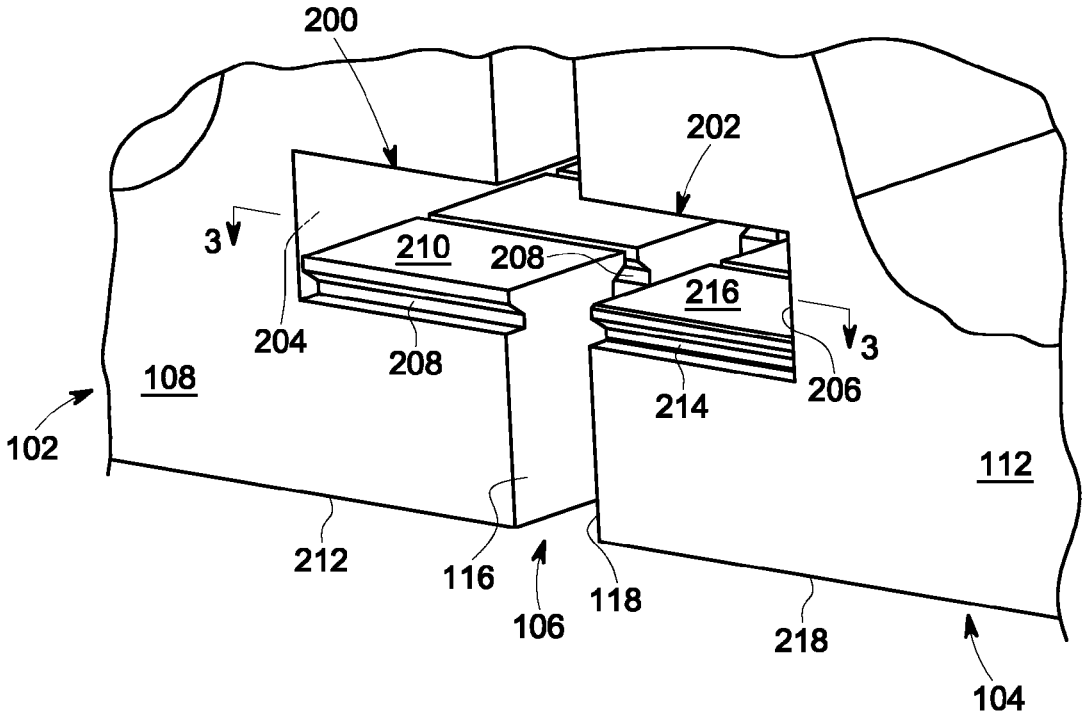
FIG. 2 is a detailed perspective view of portions of the turbine stator assembly from FIG. 1, including a first and second component.

FIG. 2 is a detailed perspective view of portions of the first component 102 and second component 104. As depicted, the interface 106 shows a substantial gap or space between the components 102, 104 to illustrate certain details but may, in some cases, have side surfaces 116 and 118 substantially proximate to or in contact with one another. The band 108 of the first component 102 has a slot 200 formed longitudinally in side surface 116. Similarly, the band 112 of the second component 104 has a slot 202 formed longitudinally in side surface 118. In an embodiment, the slots 200 and 202 run substantially parallel to the hot gas path 126 and a turbine axis. The slots 200 and 202 are substantially aligned to form a cavity to receive a sealing member (not shown). As depicted, the slots 200 and 202 run proximate from inner walls 204 and 206 to side surfaces 116 and 118, respectively. A plurality of grooves 208 are formed in a hot side surface 210 of the slot 200. Similarly, a plurality of grooves 214 are formed in a hot side surface 216 of the slot 202. The hot side surfaces 210 and 216 may also be described as on a lower pressure side of the slots 200 and 202, respectively. In addition, hot side surfaces 210 and 216 are proximate surfaces 212 and 218, which are radially inner surfaces of the bands 108 and 112 exposed to the hot gas path 126. As will be discussed in detail below, the grooves 208 and 214 are formed in the hot side surfaces 210 and 216, respectively, to cool portions of the bands 108 and 112. In addition, the grooves 208, 214 are configured to prevent a seal member positioned on the hot side surfaces 210, 216 from wearing into the grooves, which can adversely affect component cooling.

Figure 3:
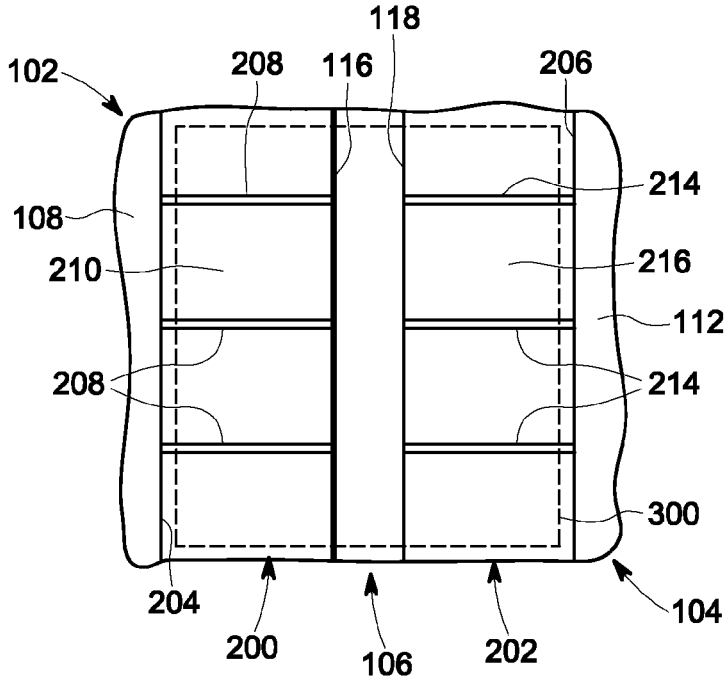
FIG. 3 is a top view of a portion of the first component and second component from FIG. 2.

FIG. 3 is a top view of a portion of the first component 102 and second component 104. The slots 200 and 202 are configured to receive a sealing member 300, which is placed on hot side surfaces 210 and 216. The grooves 208 and 214 receive a cooling fluid, such as air, to cool the first and second components 102 and 104 below the sealing member 300. Further, in an aspect, the grooves 208 and 214 may not be parallel with one another in the same component. As depicted, the grooves 208 and 214 are substantially parallel and aligned with one another. In other embodiments, the grooves 208 and 214 may be formed at angles relative to side surfaces 116 and 118 and may be staggered axially, wherein the grooves 208 are not aligned with grooves 214. As depicted, the grooves 208 and 214 are tapered or have a tapered cross-sectional geometry. In embodiments where grooves 208 and 214 do not have a tapered cross-sectional geometry (e.g., U-shaped cross section), the seal member 300 may wear due to heat and other forces and, thus, gradually deform into the grooves 208 and 214. If the seal member 300 is worn into the grooves 208 and 214, it may restrict or block flow of cooling fluid, thus causing thermal stress to the components. Accordingly, the depicted arrangement of grooves 208 and 214 provides improved cooling and enhanced turbine component life.

Figure 4:
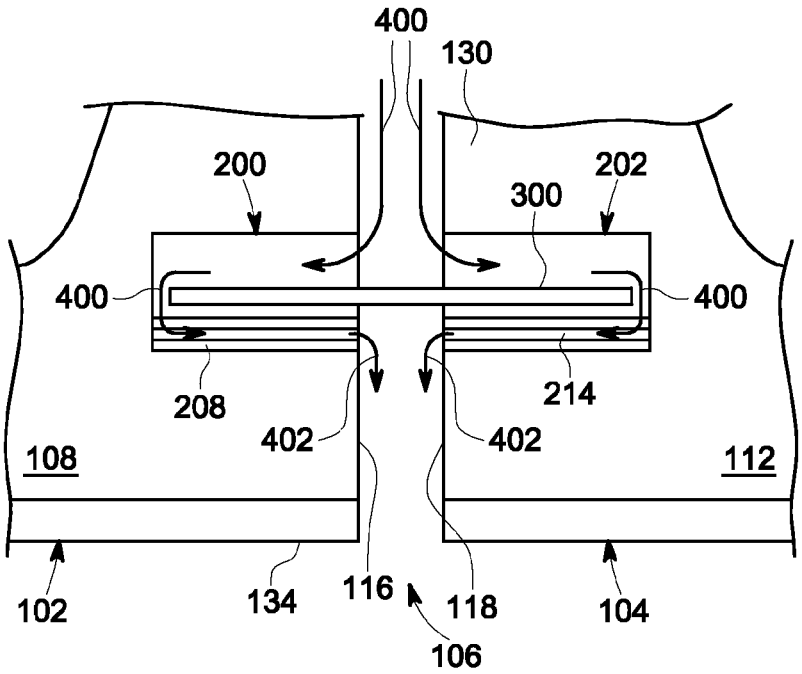
FIG. 4 is an end view of the first component and second component from FIG. 2.

FIG. 4 is an end view of a portion of the first component 102 and second component 104, wherein the sealing member 300 is positioned within the longitudinal slots 200 and 202. The interface 106 between the side surfaces 116 and 118 receives a cooling fluid flow 400 from an upper or radially outer portion of the bands 108 and 112. The cooling fluid flow 400 is directed into the slots 200 and 202 and around the sealing member 300 and along grooves 208 and 214. A cooling fluid flow 402 is then directed from the grooves 208 and 214 to side surfaces 116 and 118, where it flows radially inward toward hot gas path 126.

Figure 5:
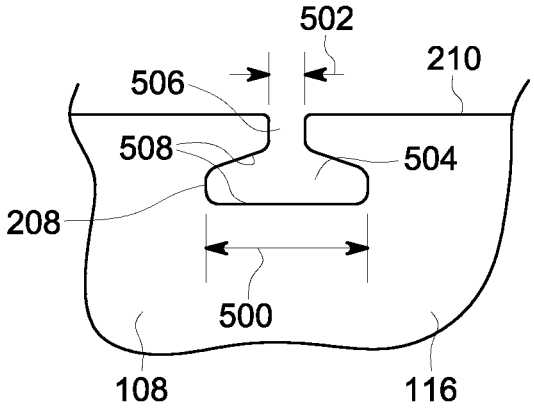
FIG. 5 is a detailed side view of a portion of the first component from FIG. 2.

FIG. 5 is a detailed side view of a portion of the band 108. The band 108 includes the groove 208, which has a tapered cross-sectional geometry. The tapered cross-sectional geometry has a narrow passage 506 with a first axial dimension 502 and a large cavity 504 with a second axial dimension 500. In an embodiment, the ratio of the second axial dimension 500 to the first axial dimension 502 is greater than 1. The narrow passage 506 prevents or reduces substantial wear of the sealing member 300 into the groove 208. In addition, the tapered cross-sectional geometry of the groove 208 has an enhanced or larger surface area of surface 508, as compared to a non-tapered cross-sectional geometry. The larger surface area of surface 508 provides enhanced heat transfer and cooling of the band 108 via fluid flow across the enhanced surface area. Accordingly, the groove 208 provides more effective cooling of the band 108, thereby reducing wear and extending the life of the component. In embodiments, the grooves 208, 214 may include surface features to enhance the heat transfer area of the grooves, such as wave or bump features in the groove.

Figure 6:
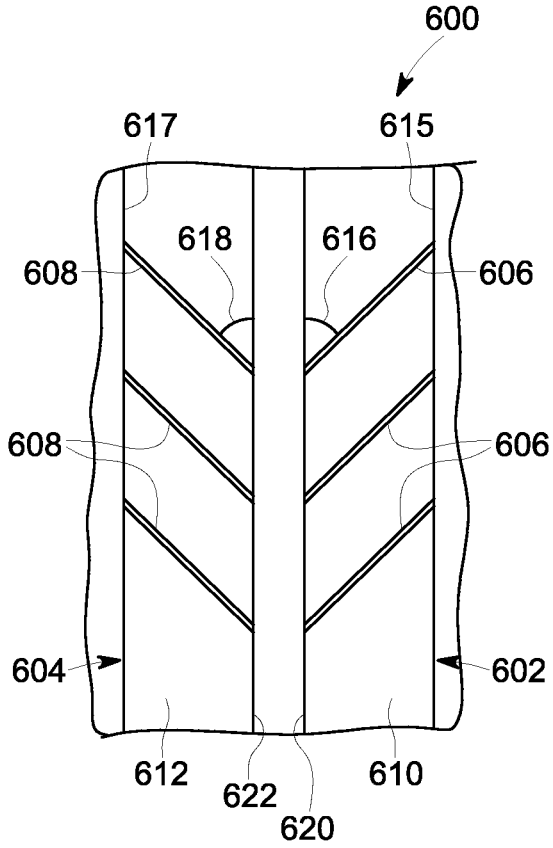
FIG. 6 is a top view of another embodiment of a portion of a first component and second component.

FIG. 6 is a top view of a portion of another embodiment of a turbine stator assembly 600 including a first component 602 and second component 604. The first component 602 includes a plurality of grooves 606 formed in a hot side surface 610. Similarly, the second component 604 includes a plurality of grooves 608 formed in a hot side surface 612. In an embodiment, the grooves 606 and 608 may include a tapered cross-sectional geometry, similar to the grooves discussed above. In addition, the grooves 606 and 608 may also be axially staggered, wherein the grooves have outlets in surfaces 620 and 622 that are not aligned. As depicted, the grooves 606 extend from an inner surface 615 to a side surface 620 of component 602 and are positioned at an angle 616 with respect to the side surface 620. The grooves 608 extend from an inner surface 617 to a side surface 622 of component 604 and are positioned at an angle 618 with respect to the side surface 622. In an embodiment, the angles 616 and 618 are less than about 90 degrees. In one embodiment, the angles 616 and 618 range from about 20 degrees to about 80 degrees. In another embodiment, the angles 616 and 618 range from about 30 degrees to about 60 degrees.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine assembly comprising:

a first component;

a second component circumferentially adjacent to the first component, wherein the first and second components each have a surface proximate a hot gas path;

a first side surface of the first component to abut to a second side surface of the second component;

a first slot formed longitudinally in the first component, wherein the first slot extends from a first slot inner wall to the first side surface;

a second slot formed longitudinally in the second component, wherein the second slot extends from a second slot inner wall to the second side surface and wherein the first and second slots are configured to receive a sealing member; and a first groove formed in a hot side surface of the first slot, wherein the first groove comprises a tapered cross-sectional geometry.

2. The turbine assembly of claim 1, comprising a second groove formed in a hot side surface of the second slot, the second groove extending to the second side surface, wherein the second groove comprises a tapered cross-sectional geometry.

3. The turbine assembly of claim 1, comprising a plurality of first grooves formed in the hot side surface of the first slot, the plurality of first grooves extending proximate the first slot inner wall to the first side surface, wherein the plurality of first grooves each comprise a tapered cross-sectional geometry.

4. The turbine assembly of claim 1, wherein the first groove is at an angle less than about 90 degrees with respect to the first side surface.

5. The turbine assembly of claim 1, wherein the tapered cross-sectional geometry comprises a narrow passage in the hot side surface leading to a large cavity radially inward of the narrow passage.

6. The turbine assembly of claim 1, wherein the tapered cross-sectional geometry comprises a passage in the hot side surface with a first axial dimension and a cavity radially inward of the passage with a second axial dimension, wherein a ratio of the second axial dimension to the first axial dimension is greater than 1, thereby providing an enhanced surface area in the first groove for heat transfer.

7. The turbine assembly of claim 1, wherein the first groove extends to the first side surface.

8. The turbine assembly of claim 1, comprising:

a plurality of first grooves formed in the hot side surface of the first slot, the plurality of first grooves extending proximate the first slot inner wall to the first side surface, wherein the plurality of first grooves each comprise a tapered cross-sectional geometry; and a plurality of second grooves formed in a hot side surface of the second slot, the plurality of second grooves extending proximate the second slot inner wall to the second side surface, wherein the plurality of second grooves each comprise a tapered cross-sectional geometry.

9. A gas turbine stator assembly including a first component to abut a second component circumferentially adjacent to the first component, wherein the first and second components each have a radially inner surface in fluid communication with a hot gas path and a radially outer surface in fluid communication with a cooling fluid, the first component comprising:

a first side surface to be joined to a second side surface of the second component;

a first slot extending from a leading edge to a trailing edge of the first component, wherein the first slot extends from a first slot inner wall to the first side surface, wherein the first slot is configured to receive a portion of a sealing member; and a first groove formed in a hot side surface of the first slot, the first groove configured to receive the cooling fluid and to direct the cooling fluid along a hot side surface of the sealing member to the first side surface, wherein the first groove comprises a tapered cross-sectional geometry.

10. The gas turbine stator assembly of claim 9, wherein the first groove extends transversely proximate the first slot inner wall to the first side surface.

11. The gas turbine stator assembly of claim 9, comprising a plurality of first grooves formed in the hot side surface of the first slot, the plurality of first grooves configured to receive the cooling fluid and to direct the cooling fluid along a hot side surface of the sealing member to the first side surface, wherein the plurality of first grooves each comprise a tapered cross-sectional geometry.

12. The gas turbine stator assembly of claim 9, comprising a second slot formed in the second component configured to substantially align with the first slot to receive a portion of the sealing member.

13. The gas turbine stator assembly of claim 12, comprising a second groove formed in a hot side surface of the second slot, the second groove configured to receive the cooling fluid and to direct the cooling fluid along a hot side surface of the sealing member to the second side surface, wherein the second groove comprises a tapered cross-sectional geometry.

14. The gas turbine stator assembly of claim 9, wherein the first groove is at an angle less than about 90 degrees with respect to the first side surface.

15. The gas turbine stator assembly of claim 9, wherein the tapered cross-sectional geometry comprises a narrow passage in the hot side surface leading to a large cavity radially inward of the narrow passage.

16. The gas turbine stator assembly of claim 9, wherein the tapered cross-sectional geometry comprises a passage in the hot side surface with a first axial dimension and a cavity radially inward of the passage with a second axial dimension, wherein a ratio of the second axial dimension to the first axial dimension is greater than 1, thereby providing an enhanced surface area in the first groove for heat transfer.

17. A turbine assembly comprising:

a first component;

a second component circumferentially adjacent to the first component, wherein the first and second components each have a surface proximate a hot gas path;

a first side surface of the first component to be joined to a second side surface of the second component;

a first slot formed longitudinally in the first component, wherein the first slot extends from a first slot inner wall to the first side surface;

a second slot formed longitudinally in the second component, wherein the second slot extends from a second slot inner wall to the second side surface and wherein the first and second slots are configured to receive a sealing member; and a plurality of first grooves formed in a hot side surface of the first slot, the plurality of first grooves extending proximate the first slot inner wall to the first side surface, wherein the plurality of first grooves each comprise a narrow passage in the hot side surface of the first slot leading to a large cavity radially inward of the narrow passage.

18. The turbine assembly of claim 17, wherein the plurality of first grooves are each at an angle less than about 90 degrees with respect to the first side surface.

19. The turbine assembly of claim 17, wherein the narrow passage has a first axial dimension and the large cavity has a second axial dimension, wherein a ratio of the second axial dimension to the first axial dimension is greater than 1, thereby providing an enhanced surface area in the first grooves for heat transfer.

20. The turbine assembly of claim 17, comprising a plurality of second grooves formed in a hot side surface of the second slot, the plurality of second grooves extending proximate the second slot inner wall to the second side surface, wherein the plurality of second grooves each comprise a narrow passage in the hot side surface of the second slot leading to a large cavity radially inward of the narrow passage.

* * * * *